US010239341B2

(12) United States Patent
Song et al.

(10) Patent No.: US 10,239,341 B2
(45) Date of Patent: Mar. 26, 2019

(54) PICTURE ALBUM

(71) Applicants: Elli Hyunju Song, Chicago, IL (US); Sukho Song, Chicago, IL (US)

(72) Inventors: Elli Hyunju Song, Chicago, IL (US); Sukho Song, Chicago, IL (US)

( * ) Notice: Subject to any disclaimer, the term of this patent is extended or adjusted under 35 U.S.C. 154(b) by 481 days.

(21) Appl. No.: 14/204,612

(22) Filed: Mar. 11, 2014

(65) Prior Publication Data

US 2015/0367671 A1 Dec. 24, 2015

Related U.S. Application Data

(60) Provisional application No. 61/776,713, filed on Mar. 11, 2013, provisional application No. 61/926,965, filed on Jan. 14, 2014.

(51) Int. Cl.
*B42F 11/00* (2006.01)
*B42F 13/00* (2006.01)
*B42F 13/16* (2006.01)

(52) U.S. Cl.
CPC ..... *B42F 11/00* (2013.01); *B42F 13/0026* (2013.01); *B42F 13/16* (2013.01)

(58) Field of Classification Search
CPC ... B42D 1/00; B42D 3/04; B42D 5/00; B42D 1/08; B42D 3/00; B42D 15/00; B42F 5/00; B42F 13/00
USPC ..... 281/3.1, 4, 15.1, 20, 22, 29; 283/63.1, 283/64; 402/73, 74, 75, 76, 77, 78
See application file for complete search history.

(56) References Cited

U.S. PATENT DOCUMENTS

| | | | | |
|---|---|---|---|---|
| 2,284,355 | A | 5/1942 | Anderson | |
| 5,016,752 | A | 5/1991 | Haugen, Jr. | |
| 5,375,351 | A | 12/1994 | King | |
| 8,573,471 | B2 | 11/2013 | Wong | |
| 2005/0117964 | A1* | 6/2005 | Johnson | B42D 1/08 402/73 |
| 2006/0038394 | A1* | 2/2006 | Henley | B42D 1/08 281/21.1 |
| 2009/0090709 | A1* | 4/2009 | Shalomoff | B65D 11/1833 220/6 |
| 2012/0037693 | A1* | 2/2012 | Wong | B65D 5/241 229/186 |

(Continued)

OTHER PUBLICATIONS

Folding wine box: http://www.thenewrange.com.au/2014/product.asp?iProductId=10967&iSubCategory=6698.

(Continued)

*Primary Examiner* — Justin V Lewis
(74) *Attorney, Agent, or Firm* — Faegre Baker Daniels LLP

(57) ABSTRACT

A picture album can include a picture frame and has a front cover panel, back cover panel, and four side panels, all in a rectangular shape and covered by a material. The edges of the sides and the front cover have embedded magnets that allow the album to open flat and recover its original shape through engaging magnetic force when closed.
Multiple picture sheets can be stored in the album using a multi-ring binder spine hardware. A display window is located on the front cover panel where a picture insertion sheet can be attached to the back of the display window by magnetic force so that a picture located in the picture insertion sheet can be viewed through the display window located on the front cover panel.

12 Claims, 9 Drawing Sheets

(56) References Cited

U.S. PATENT DOCUMENTS

2013/0161214 A1* 6/2013 Nebeker ..... B65D 5/3657
206/307

OTHER PUBLICATIONS

Pioneer PBX-120 3-Ring Photo Album Box: http://www.pfile.com/product/k-pbx-120/?r=GB-K-PBX-120&utm_source=google+products&utm_medium=leed&utm_campaign=GB-K-PBX-120&gclid=CMDdk.

* cited by examiner

PICTURE ALBUM

This application claims priority from provisional applications 61/776,713 and 61/926,965.

BACKGROUND OF THE INVENTION

1. Field of the Invention

The present invention relates to a picture album.

2. Description of the Prior Art

Foldable boxes with collapsible side panels are available in the prior art. However, they require additional flaps or supporting parts to become flat, and they do not provide a clean look or a quick and easy operation. For example, U.S. Pat. No. 8,573,471 can lay flat all side panels, but the operation is assisted by foldable subpanels. The magnets of the prior art are for the purpose of closure only. Picture albums covered in the material for design purpose cannot use the structure of U.S. Pat. No. 8,573,471, because foldable subpanels will increase the thickness and make it difficult to perform the folding function. Also, the prior art was designed for securing packages (i.e. the closed position), not for the constant toggling between two modes of operation: picture frame (closed position) and picture album (open position).

SUMMARY

The structure of prior art references have shortcomings and lack the full function of picture album. The present embodiments of the picture album address the shortcomings. Moreover, a picture insertion sheet can be attached to a cover of the album and changed quickly and easily with a magnetic self-alignment.

One embodiment of the picture album includes: a front cover panel, back cover panel, and four side panels, all in rectangular shape and covered in a fabric, paper, vinyl or real or imitation leather material (henceforth called "the material"). The four side panels can lie flat when the picture album opens. The edges of the sides and the front cover have embedded magnets that allow the structure of the album to recover its original shape by engaging magnetic force.

The magnets are embedded along each edge of each panel where they function with magnets of opposing polarity located on the edge of an intersecting panel, with intersecting panels joining at perpendicular angles.

The size and strength of the magnets are sufficient to create the necessary tension among the four sides of the picture album so that the album may both recover its original shape and lie flat when opened.

The album has depth sufficient to store multiple picture sheets organized using a multi-ring binder spine hardware.

A display window is located on the front cover panel. A picture insertion sheet can be attached to the back of the display window using magnets embedded at the corners of each edge of a second display window located on the picture insertion sheet, so that a picture placed in the picture insertion sheet may be viewed through the display window on the front cover panel.

The picture insertion sheet may come in various sizes and shapes (e.g., a sheet for a 4"×6" or 5"×7" rectangular photo, or a sheet with an eclipse, a heart or a star-shaped opening). The picture insertion sheet has a pull tab to facilitate removing the picture insertion sheet from the display window.

A foldable back stand can be attached to the back cover panel so that the picture album can sit upright on a flat surface. Hanging hardware attached on the back cover panel allows the picture album to hang either vertically or horizontally, as a picture frame.

DETAILED DESCRIPTION OF DRAWINGS

Figure 1:
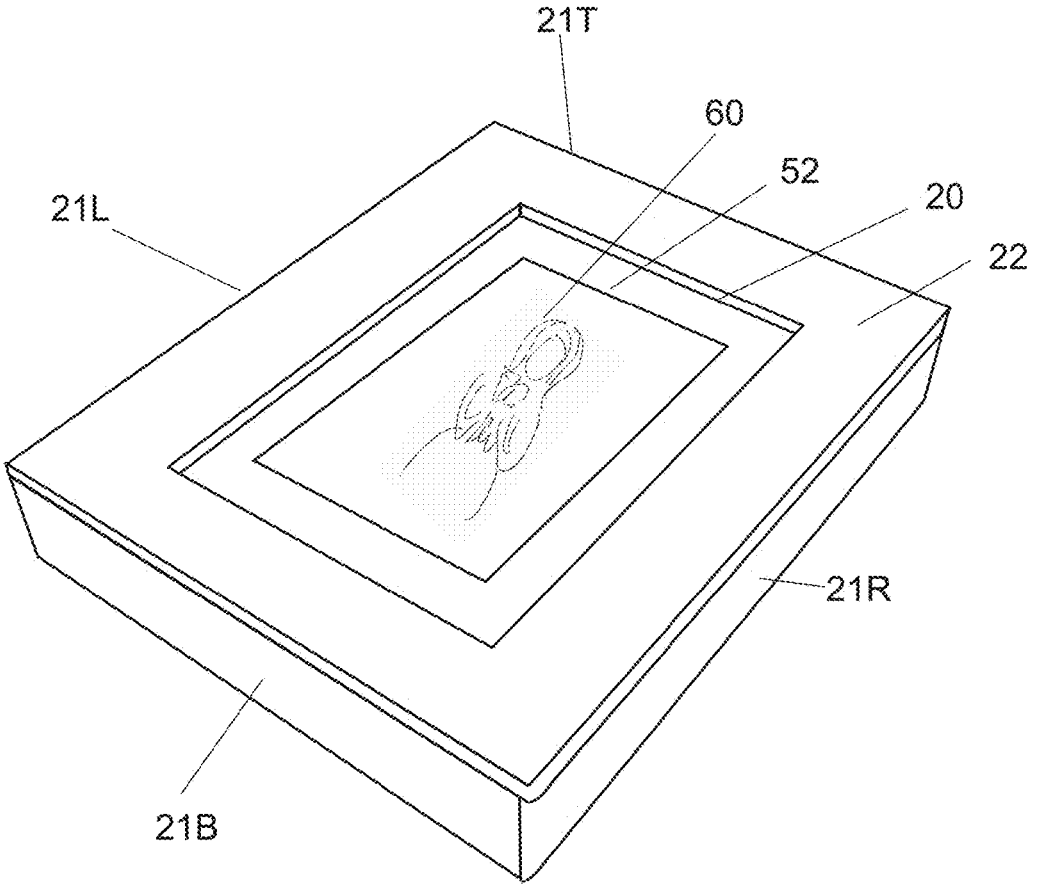
FIG. 1 is a top perspective view from above of a picture album when closed and covered with the material. The picture album contains a picture on the front.

Referring to FIG. 1, one embodiment of the present invention is shown in a front view when the picture album is closed and in the form of a picture frame. A front cover lid panel 22 is rectangular in shape having a picture frame. The frame includes an opening serving as a viewing window 20 for a picture 60. The front cover lid panel 22 is secured to the left side panel 21L of the frame by the material (e.g. fabric, leather, vinyl, etc.), which functions as a hinge. The material is attached to the panels by adhesive, with a small space between adjacent panels, so that the panels can move with respect to each other using the material between the panels as the hinge.

The top side panel 21T, the bottom side panel 21B, and the right side panel 21R are connected to the front cover lid panel 22. A picture 60 on a picture insertion sheet 52 is displayed through a viewing window and through the viewing window 20 on the front cover.

Figure 2:
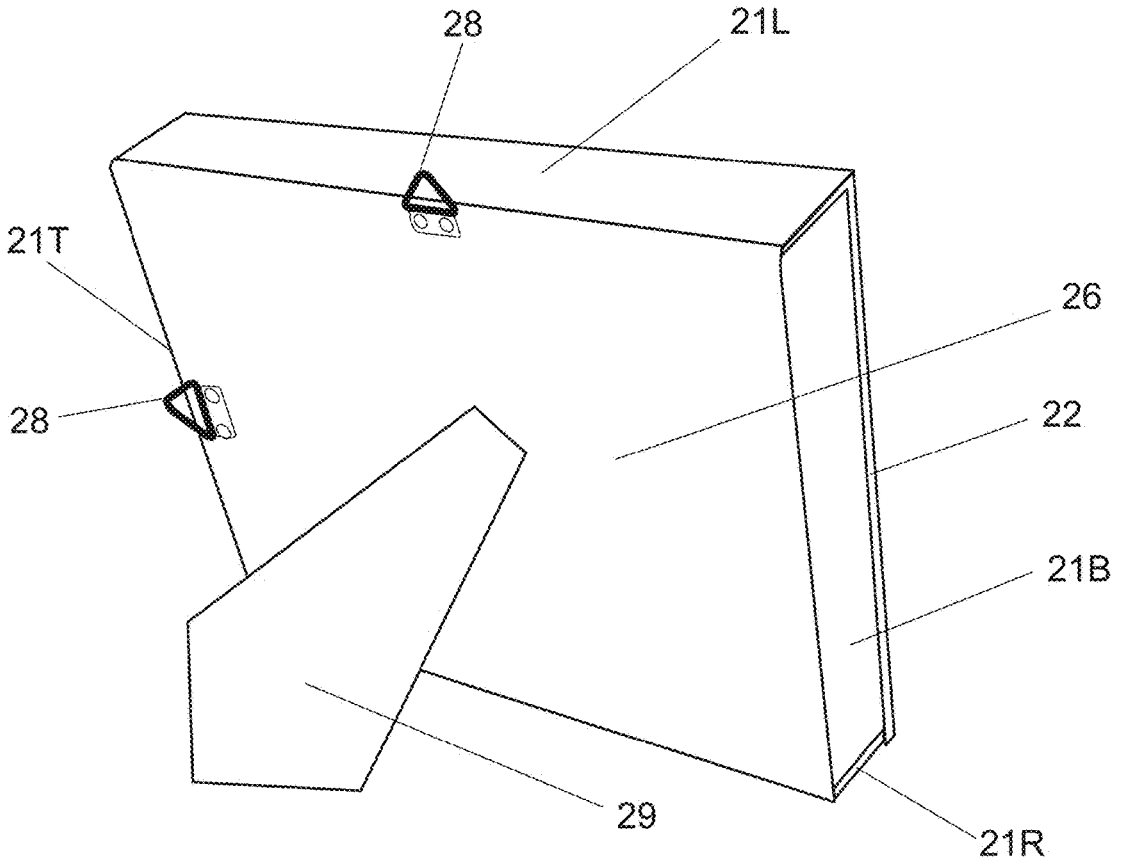
FIG. 2 is a back perspective view from the side of the picture album when closed and covered with the material. The foldable back stand is open to stand the picture album on a flat surface.

Turning to FIG. 2, the picture album is shown in a back view, when it is closed and in the form of a picture frame. A back panel 26 in a rectangular shape is attached to a top side panel 21T, right side panel 21R, bottom side panel 21B, and a left side panel 21L, which connect the back panel 26 to the front cover lid panel 22. The back panel 26 has hanging hardware 28 (e.g. hangers, mounting holes, etc.) to hang the picture album either horizontally or vertically on a wall. The back panel also has a foldable back stand 29 shown in the open position in FIG. 2, which allows the picture album to stand on a flat surface in a portrait or landscape position. In this illustration the picture album is shown covered by the material, with the base structure and magnets unseen.

Figure 3:
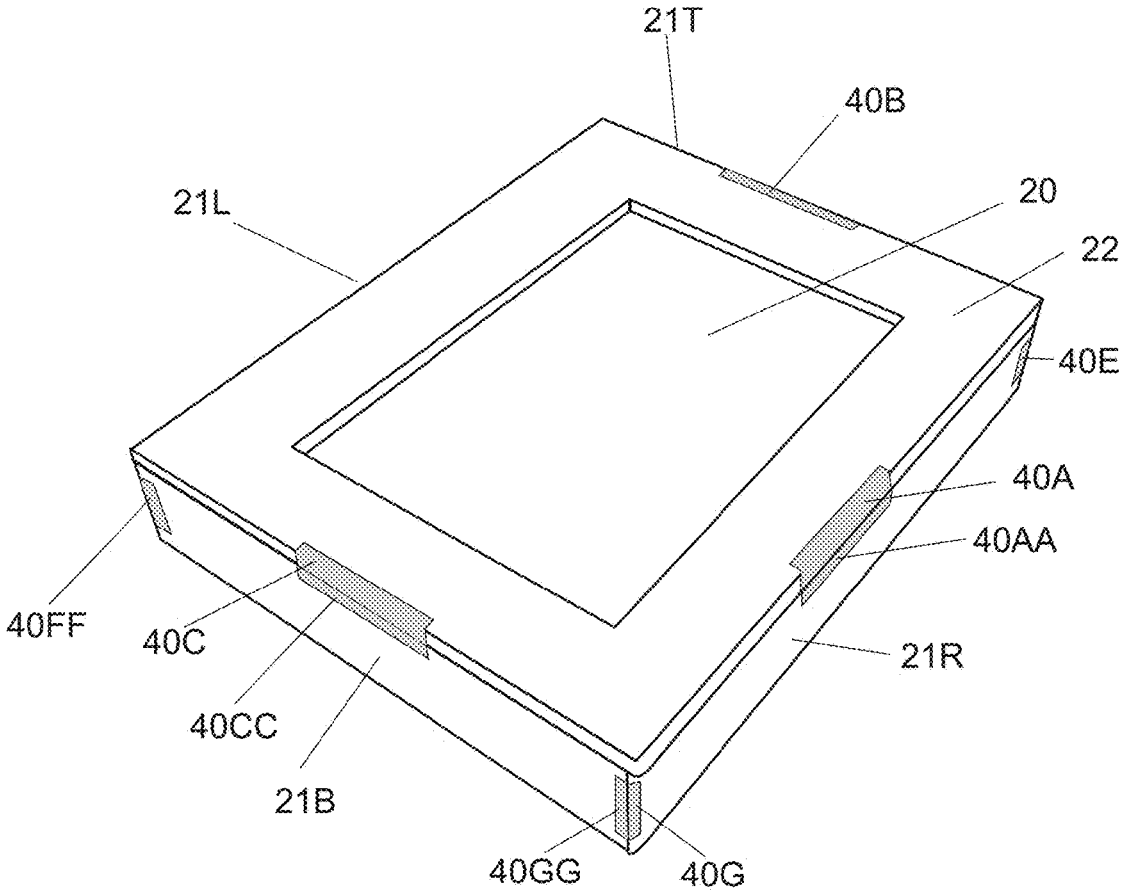
FIG. 3 is a top perspective view from above of the picture album when closed and without the material covering.

In FIG. 3, the picture album is shown in a front view, when it is closed and is in the form of a picture frame. The material is not shown and the base structure and magnets are visible. The front cover lid panel 22 is shown in a rectangular shape and includes an opening serving as the viewing window 20 for a picture. The five panels (21T, 21B, 21L, 21R, and 22) are selectively connected by using the embedded magnets (40A, 40AA, 40B, 40C, 40CC, 40E, 40FF, 40G, and 40GG) by engaging magnetic force.

Figure 4:
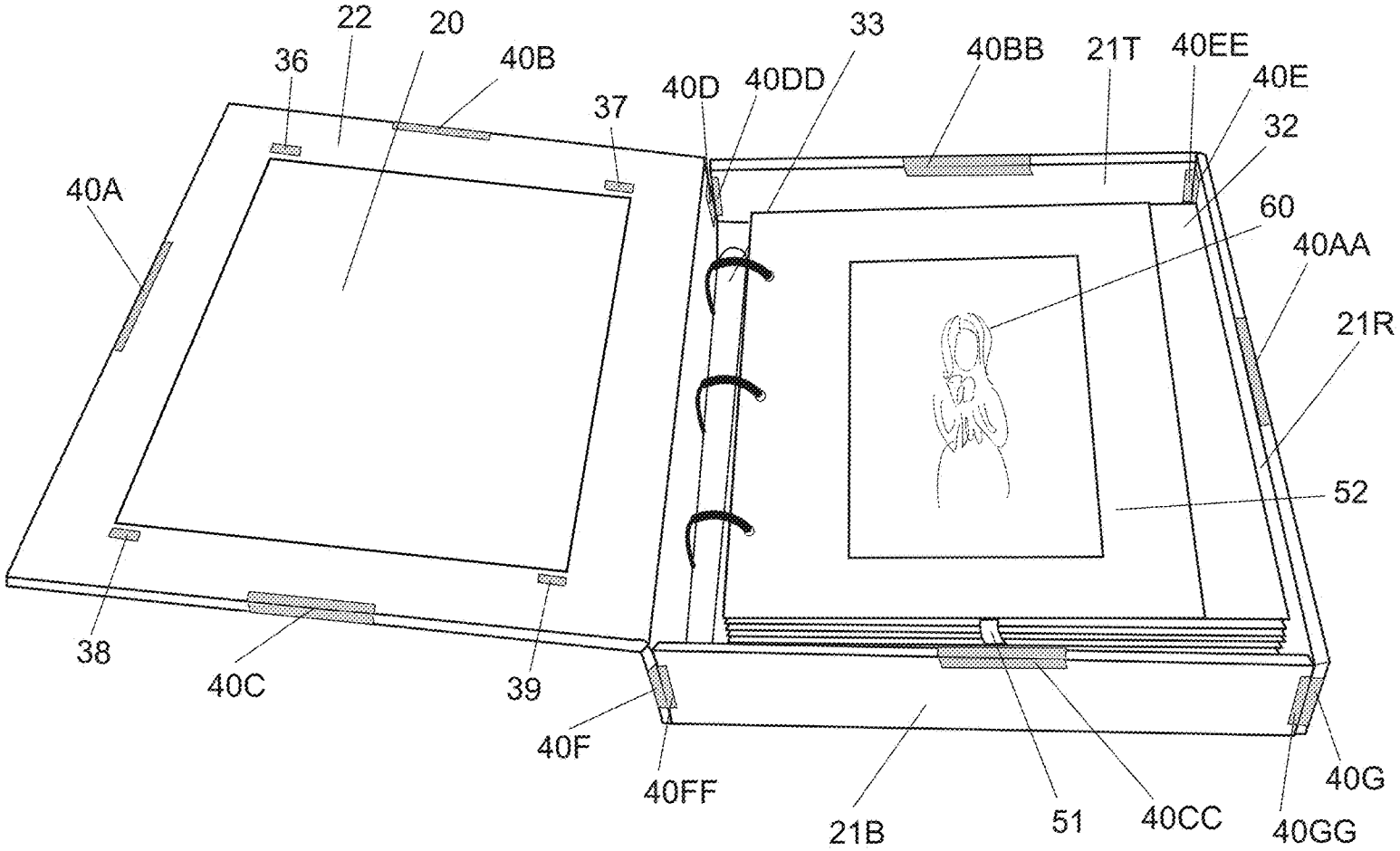
FIG. 4 is a top view of the picture album when the front cover lid panel is opened and is shown without the material covering. A multi-ring binder spine hardware is secured to the back panel with picture sheets and picture insertion sheets stored and organized along the ring binder spine.
Figure 5:
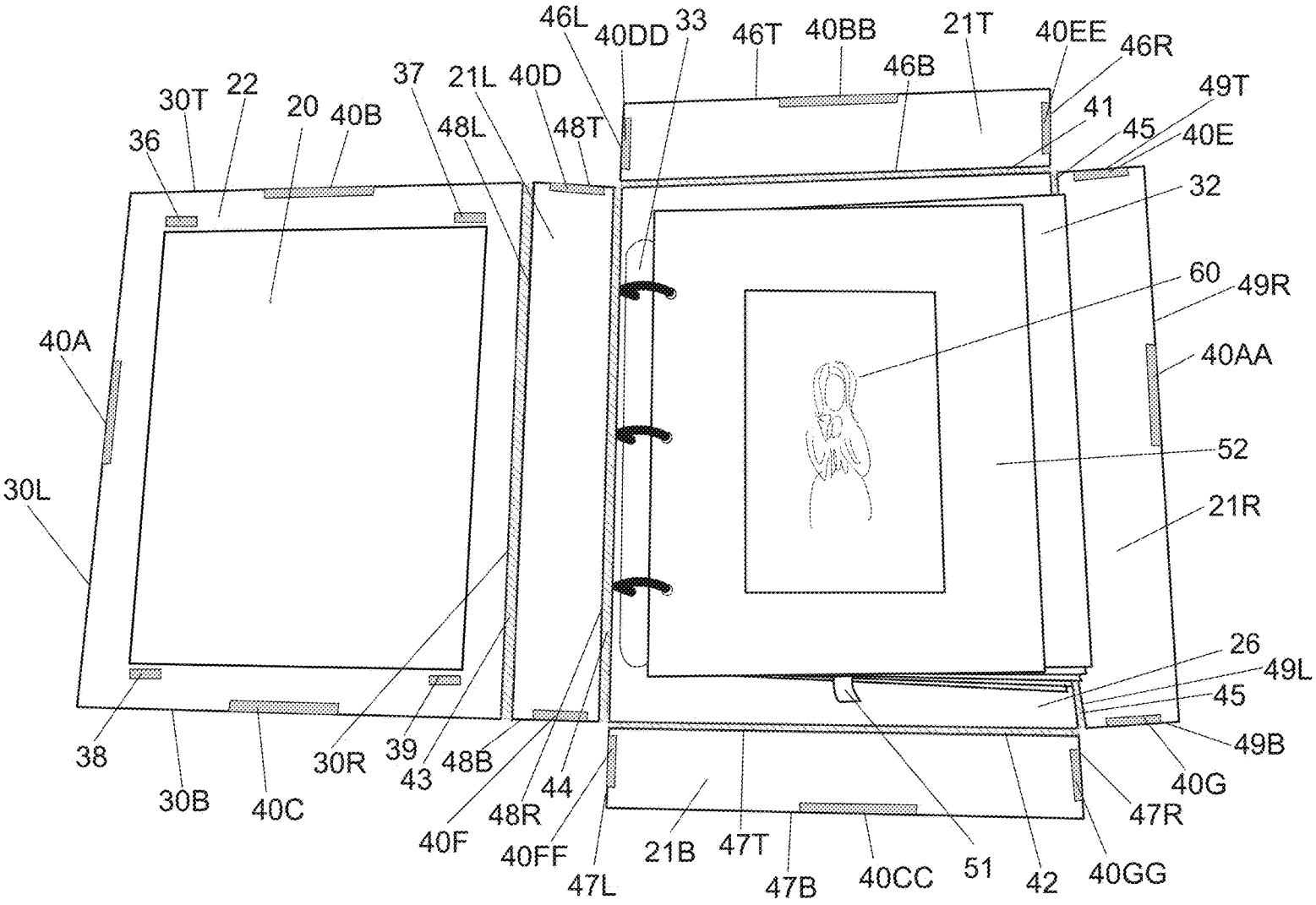
FIG. 5 is a top view of the picture album when the front cover lid panel and all four side panels (top side panel, bottom side panel, left side panel, and right side panel) are opened to lie flat to facilitate organizing pictures inside the album.

FIGS. 4 and 5 show the picture album in the open position and in the form of a picture album. FIG. 4 shows when the front cover lid panel 22 is open and FIG. 5 shows when the five panels (21T, 21B, 21L, 21R, and 22) are opened to lie flat, to facilitate organizing pictures inside the album.

This embodiment of the picture album has the back panel 26 in a rectangular shape attached to the upper side panel 21T, right side panel 21R, lower side panel 21L, and the left side panel 21L, in which the left side panel 21L connect the back panel 26 to the front cover lid panel 22. All the panels have a rigid structure covered by the material and a multi-ring binder spine hardware 33 is secured to the back panel 26 over the material. A plurality of picture sheets 32 or picture insertion sheets 52 may be secured and stored along the multi-ring binder spine.

The upper side panel 21T is in a rectangular shape and has a top edge 46T, a bottom edge 46B opposite the top edge 46T, and left 46L and right 46R side edges. The upper side panel 21T is secured to the back panel 26 by the material, which binds the panels together to produce a hinge at 41 when the material is in place.

A first magnet 40BB is embedded along the top edge 46T of the upper side panel between the left 46L and right 46R side edges. A second magnet 40DD is embedded along the left side edge 46L of the upper side panel 21T. A third magnet 40EE embedded along the right side 46R edge of the upper side panel 21T. The three magnets embedded in the upper side panel 21T can be aligned to allow the panel to close and secure to the right side panel 21R, left side panel 21L, and front cover lid panel 22 using magnetic force.

The lower side panel 21B is rectangular in shape having, a top edge 47T, a bottom edge 47B opposite the top edge 47T, and left 47L and right 47R side edges. The lower side panel 21B is secured to the back panel 26 by the material, which binds the panels together to produce a hinge at 42 when the material is in place.

A fourth magnet 40CC is embedded along the bottom edge 47B of the lower side panel 21B between the left 47L and right 47R side edges, and a fifth magnet 40FF is embedded along the left side edge 47L of the lower side panel 21B. A sixth magnet 40GG is embedded along the right side edge 47R of the lower side panel 21B. The three magnets embedded in the lower side panel 21B can be aligned to allow the panel to close and secure to the right side panel 21R, left side panel 21L, and front cover lid panel 22 using magnetic force.

A left side panel 21L is rectangular in shape, having a top edge 48T, a bottom edge 48B opposite the top edge 48T, and left 48L and right 48R side edges. The left side panel 21L is secured to the front cover lid panel 22 by the material to produce a hinge at 43 between the left side panel and front lid cover lid panel. The left side panel 21L is secured to the back panel 26 by the material to produce a hinge at 44 between the left side panel 21L and back panel 26.

A seventh magnet 40D is embedded along the top edge 48T of the left side panel 21L, and an eighth magnet 40F is embedded along the bottom edge 48B of the left side panel 21L. The two magnets embedded in the left side panel 21L can be aligned to allow the panel to close, and secure to the upper side panel 21T and lower side panel 21B using magnetic force.

A right side panel 21R is rectangular in shape, having a top edge 49T, a bottom edge 49B opposite the top edge 49T, and left 49L and right 49R side edges, wherein, the right side panel 21R is secured to the back panel 26 by the material which binds the panels together to produce a hinge at 45 when the material is in place. A ninth magnet 40E is embedded along the top edge 49T of the right side panel 21R, and a tenth magnet 40AA is embedded along the right side edge 49R of the right side panel 21R. An eleventh magnet 40G is embedded along the bottom edge 49B of the right side panel 21R. The three magnets embedded in the right side panel 21R can be aligned to allow the panel to close and secure to the upper side panel 21T, lower side panel 21B, and front cover lid panel 22 using magnetic force.

A front cover lid panel 22 is rectangular in shape, having a top edge 30T, a bottom edge 30B opposite the top edge 30T, and left 30L and right 30R side edges, serving as a picture frame, wherein, the front cover lid panel 22 is covered by the material, and secured to the left side panel 21L by the material which binds the panels together to produce the hinge at 43 when the material is in place. The front cover lid panel 22 includes the rectangular opening 20, serving as a viewing window for a picture.

A twelfth magnet 40B is embedded along the top edge 30T of the front cover lid panel 22, and a thirteenth magnet 40A is embedded along the left side edge 30L of the front cover lid panel 22. A fourteenth magnet 40C is embedded along the bottom edge 30B of the front cover lid panel 22. The three magnets embedded in the front cover lid panel 22 can be aligned to allow the panel to close and secure to the upper side panel 21T, lower side panel 21B, and right side panel 21R using magnetic force.

The upper side panel 21T, lower side panel 21B, left side panel 21L, and right side panel 21R are connected to the back panel 26, and can be opened to lie flat to facilitate organizing pictures inside the album. The five panels (21T, 21B, 21L, 21R, and 26) can return to their original shape by using the embedded magnets by engaging the magnets' magnetic force.

Figure 6:
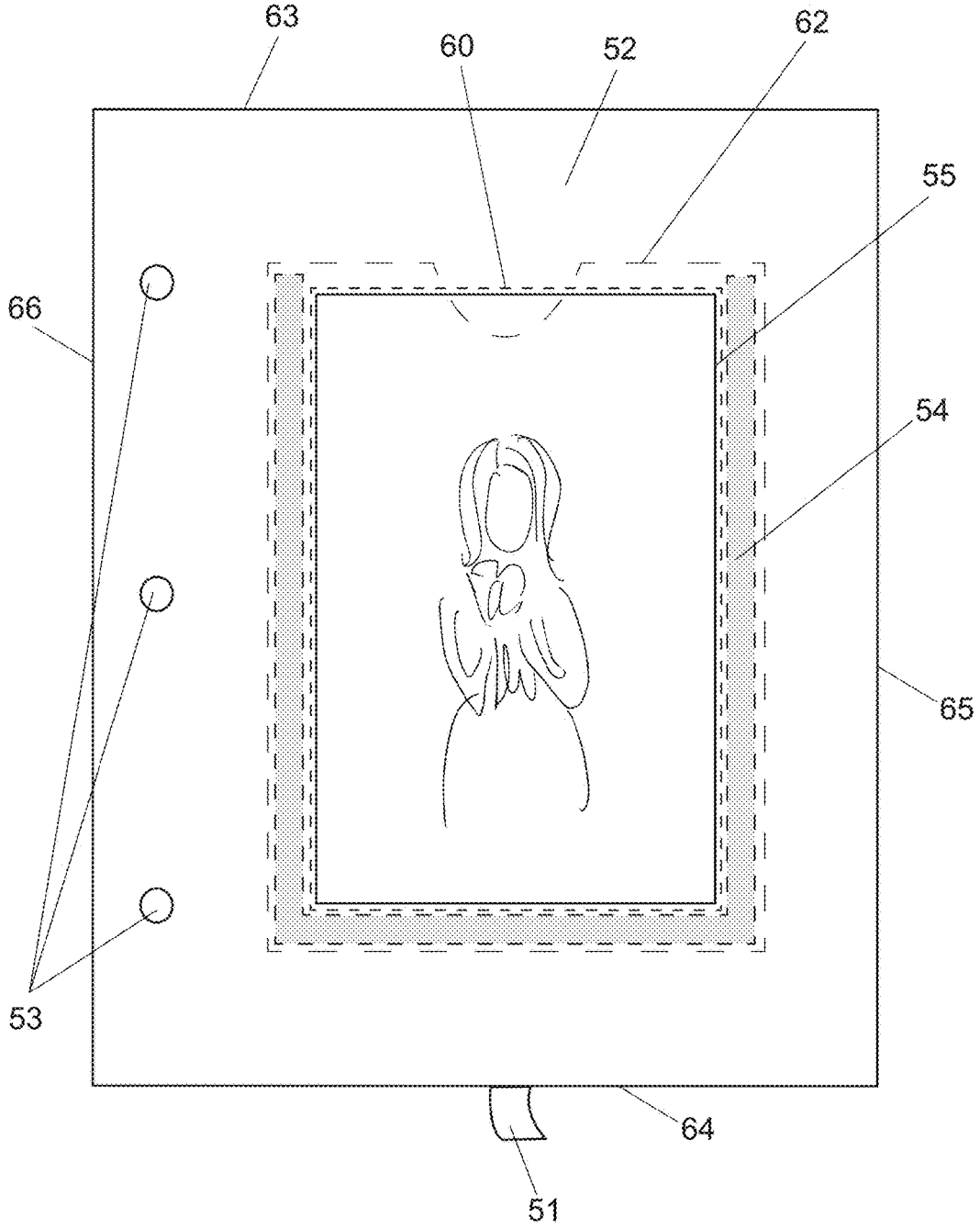
FIG. 6 is a front view of the picture insertion sheet with a picture inserted in the back pocket of a picture insertion sheet.
Figure 7:
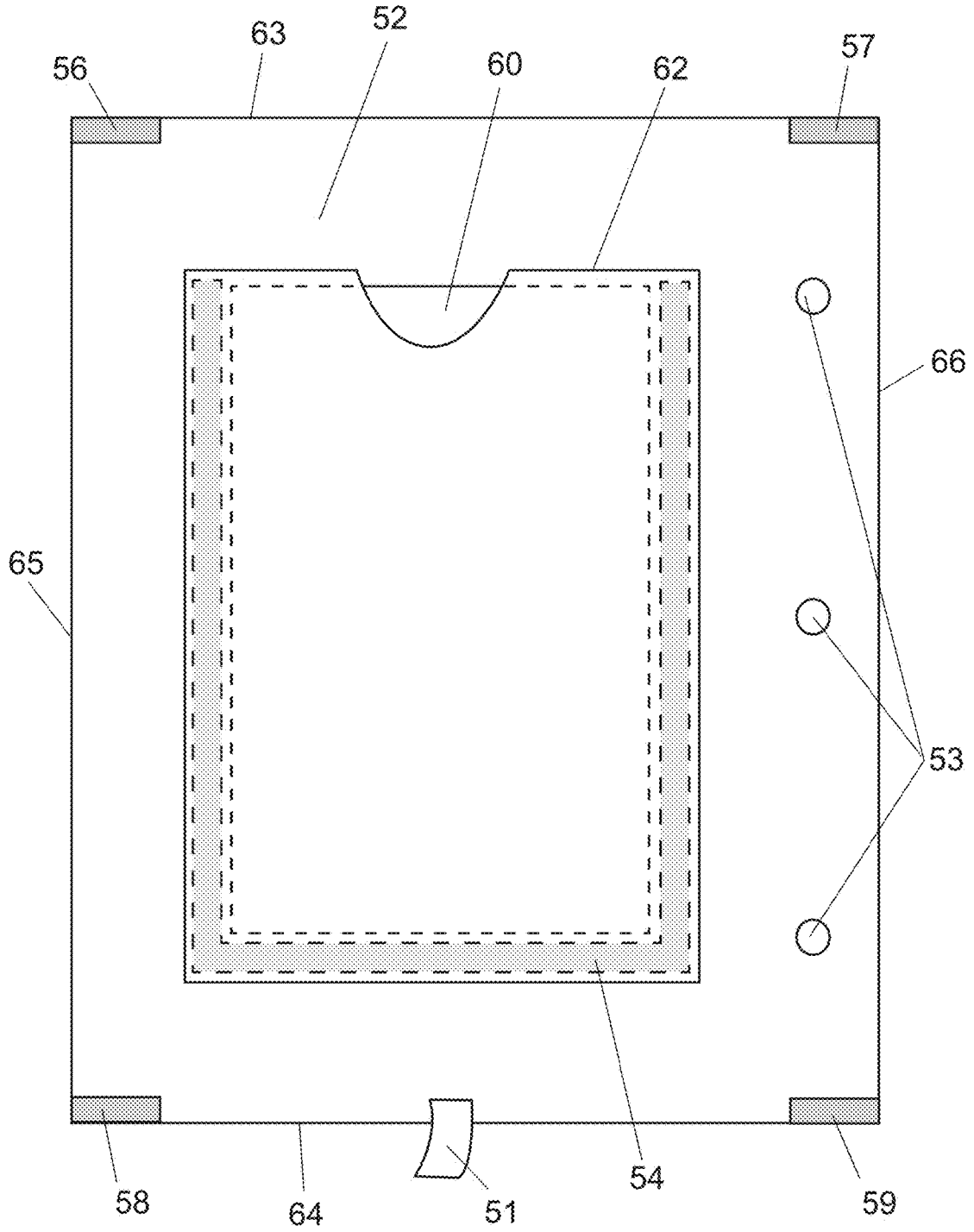
FIG. 7 is a back view of the picture insertion sheet with a picture inserted.

FIG. 6 shows a front view of a picture insertion sheet and FIG. 7 shows a back view of a picture insertion sheet. The picture insertion sheet 52 is of rectangular shape and has a top edge 63, a bottom edge 64 opposite the top edge, and a left edge 66 and a right side edge 65; and a front viewing window 55 of a rectangular, oval, heart or other shape, and a back pocket 62 of rectangular shape. A picture 60 may be inserted into the back pocket 62 so that the picture may be viewed through the front viewing window 55.

Referring to FIG. 7, under the back pocket 62, which holds a picture 60, rail 54 is attached between the picture insertion sheet 52 and the back pocket 62. The rail 54 creates the gap between the picture insertion sheet 52 and the back pocket 62 so that a picture 60 can be inserted smoothly and easily between them. Punch holes 53 are engaged to a multi-ring binder spine hardware 33 to keep the picture sheets 38 and the picture insertion sheets 52.

A pull tab 51 is located along the bottom edge of the picture insertion sheet 52 to facilitate removal of the picture insertion sheet 52 from the front cover lid panel 22. A plurality of magnets on the picture insertion sheet (56, 57, 58 and 59) attach to the corners of the front cover lid using panel magnets 36, 37, 38, and 39 respectively. Attaching the picture insertion sheet 52 to the back of the viewing window in the front cover lid panel 22, allows a picture 60 to be seen through the viewing window 55, as well as through the viewing window 20 located in the front cover lid panel 22.

Figure 8:
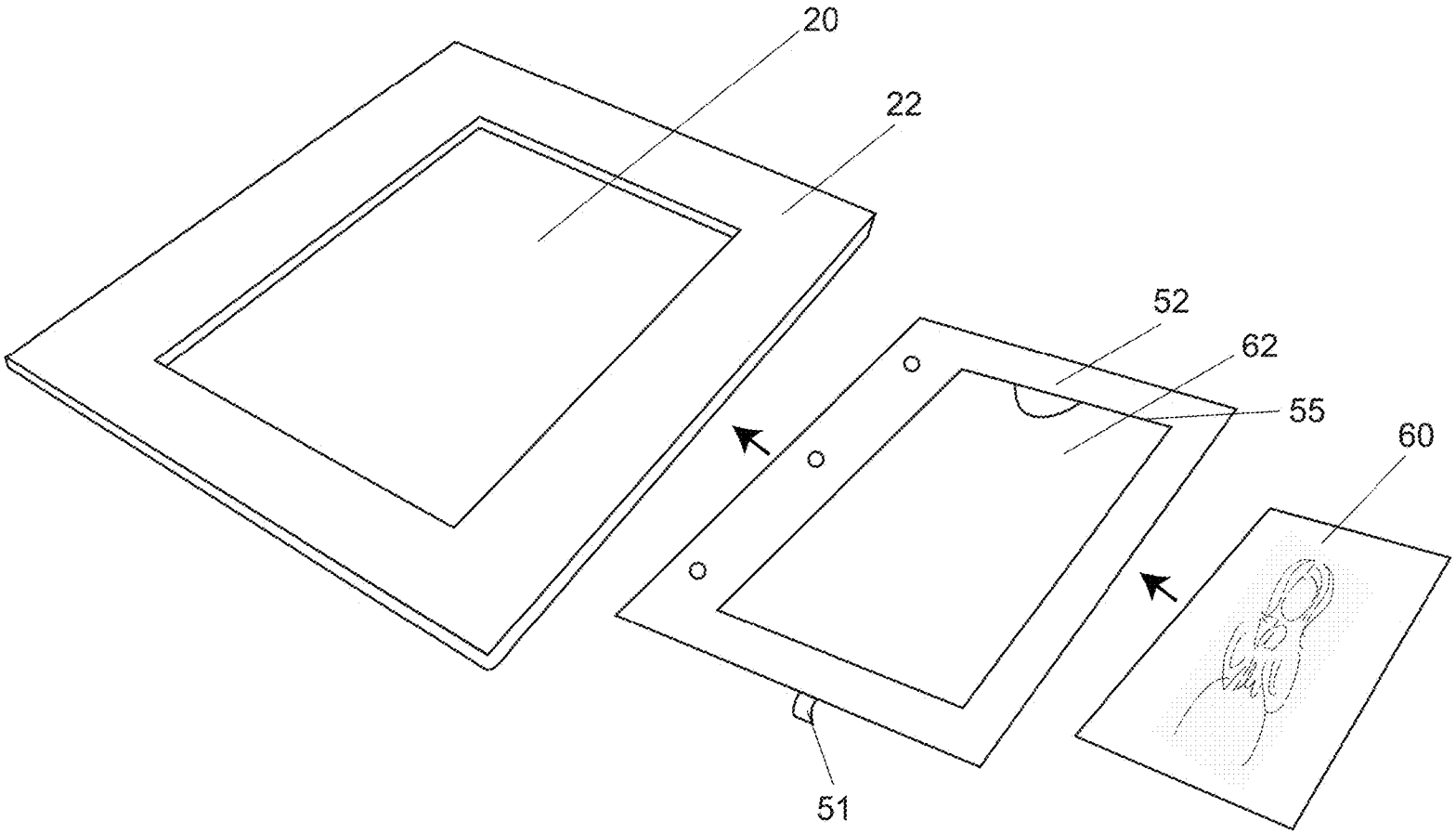
FIG. 8 is a top perspective view showing how to add a picture to display through a viewing window on the picture insertion sheet and then through a viewing window on the front cover lid panel.

FIG. 8 shows how a picture 60 can be viewed in the picture album when it is in the form of a picture frame. A picture 60 will be inserted to the back pocket 62 of a picture insertion sheet 52 and can be seen through the viewing window 55 of the picture insertion sheet 52. Then, the picture insertion sheet 52 will be attached to the back of the front cover lid 22 using magnetic force. The picture 60 will be shown through a viewing window 20 on the front cover lid 22. FIG. 1 shows the final view after assembly.

Figure 9:
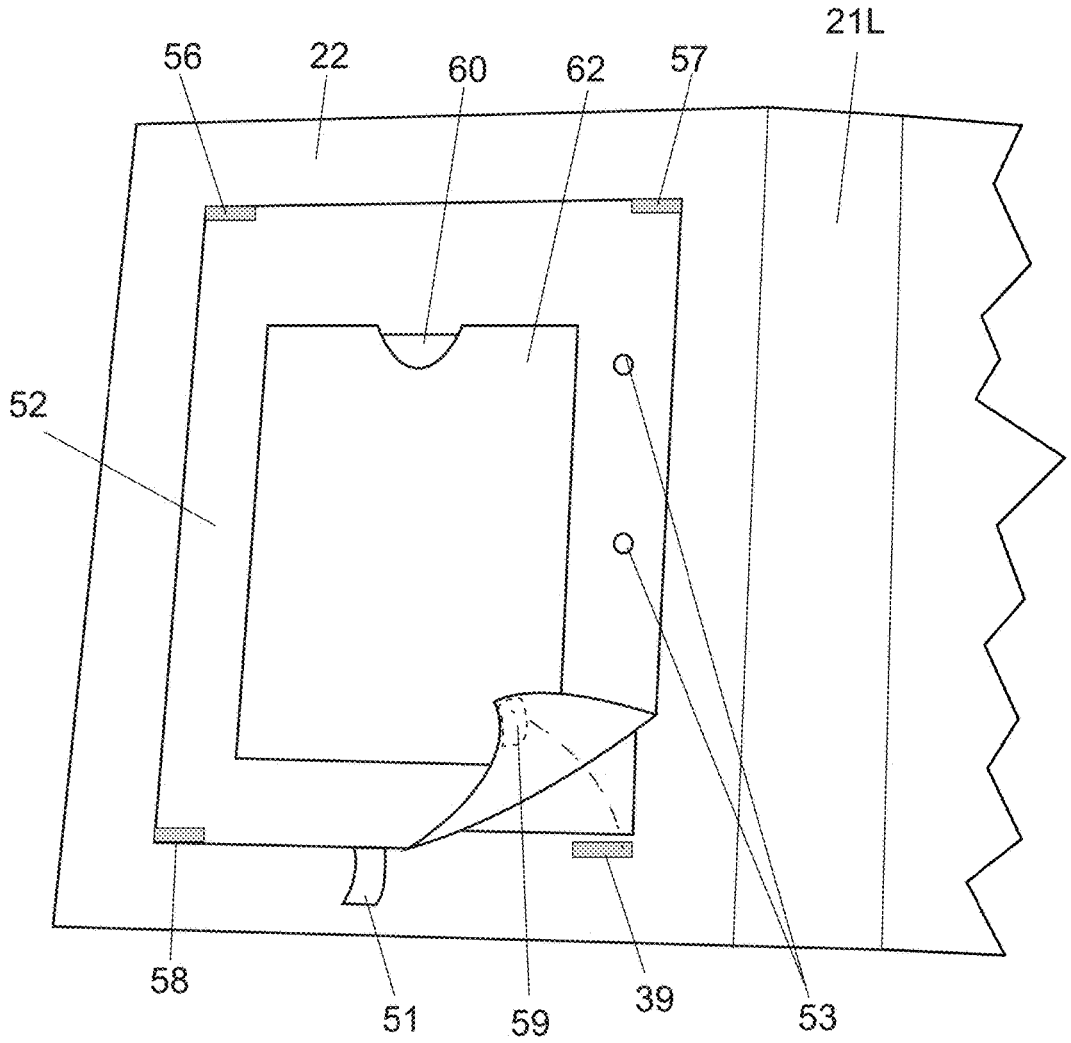
FIG. 9 is a top view of the back of the front cover lid panel of the picture album when the picture insertion sheet with a picture is engaged to the back of the front cover lid. The bottom right corner of the picture insertion sheet is lifted up to show how magnets are engaged between the picture insertion sheet and the front cover lid.

FIG. 9 shows a picture insertion sheet 52 containing a picture 60 after it has been taken out of the binder side and is being placed on the inside of the front cover lid 22. The picture insertion sheet 52 may attach to the back of the viewing window 20 located on the front cover lid panel 22 so that a picture 60 may be seen through both viewing windows (20 and 55). The magnets on the picture insertion sheet 56, 57, 58, and 59 are aligned with magnets on the front cover lid 36, 37, 38 and 39 (see FIG. 4 or 5) by magnetic force. The bottom right corner of a picture insertion sheet 52 is lifted up to show how the magnet 59 on the picture insertion sheet 52 is aligned with the magnet 39 on the front cover lid panel 22.

What is claimed is:

1. A picture album comprising:

a back panel in a rectangular shape attached to an upper side panel, right side panel, lower side panel, and a left side panel, in which the left side panel connects the back panel to a front cover lid panel;

all panels having a rigid structure covered by a material; the upper side panel being in a rectangular shape having a top edge, a bottom edge opposite the top edge, and left and right side edges, wherein, the upper side panel is secured to the back panel by the material which binds the upper side panel and the back panel together to produce a hinge;

a plurality of magnets embedded along the edges of the upper side panel to allow the upper side panel to close and secure to the right side panel, the left side panel, and the front cover lid panel using magnetic force;

the lower side panel being in a rectangular shape having a top edge, a bottom edge opposite the top edge, and left and right side edges, wherein, the lower side panel is secured to the back panel by the material which binds the lower side panel and the back panel together to produce a hinge;

a plurality of magnets embedded along the edges of the lower side panel to allow the lower side panel to close and secure to the right side panel, the left side panel, and the front cover lid panel using magnetic force;

the left side panel being in a rectangular shape having a top edge, a bottom edge opposite the top edge, and left and right side edges, wherein, the left side panel is secured to the front cover lid panel by the material to produce a hinge between the left panel and front lid cover lid panel;

the left side panel is secured to the back panel by the material to produce a hinge between the left panel and back panel;

a plurality of magnets embedded along the edges of the left side panel to allow the left side panel to close and secure to the upper side panel and the lower side panel using magnetic force;

the right side panel being in a rectangular shape having a top edge, a bottom edge opposite the top edge, and left and right side edges, wherein, the right side panel is secured to the back panel by the material which binds the right side panel and the back panel together to produce a hinge;

a plurality of magnets embedded along the edges of the right side panel to allow the right side panel to close and secure to the upper side panel, the lower side panel, and the front cover lid panel using magnetic force;

the front cover lid panel being in a rectangular shape having a top edge, a bottom edge opposite the top edge, and left and right side edges, serving as a picture frame, wherein, the front cover lid panel is covered by the material and secured to the left side panel by the material which binds the left side panel and the front cover lid panel together to produce a hinge, wherein, the front cover lid panel includes an opening serving as a viewing window to view a picture;

a plurality of magnets embedded along the edges of the front cover lid panel to allow the front cover lid panel to close and secure to the upper side panel, the lower side panel, and the right side panel using magnetic force, wherein the upper side panel, the lower side panel, the left side panel, and the right side panel are connected to the back panel and can be opened to lie flat when the picture album is opened to facilitate organizing pictures inside the picture album;

a picture insertion sheet with a top edge, a bottom edge opposite the top edge, and left and right side edges; and one or more magnets attached to at least one corner of the picture insertion sheet.

2. The picture album of claim 1, further comprising a front view window on the picture insertion sheet.

3. The picture album of claim 2, further comprising a back pocket; wherein, a picture is inserted into the back pocket so that the picture is viewable through the front viewing window located on the picture insertion sheet.

4. The picture album of claim 1, further comprising a second plurality of magnets embedded in the front cover lid panel at corners of the viewing window;

wherein, the second plurality of magnets align with the first plurality of magnets attached at the corners of the picture insertion sheet to allow the picture insertion sheet to attach to a back of the viewing window located on the front cover lid panel so that a picture is seen through the viewing window located on the picture insertion sheet, as well as through the viewing window located on the front cover lid panel.

5. The picture album of claim 1, wherein the plurality of magnets embedded along the edges of the upper side panel comprise a first magnet embedded along the top edge of the upper side panel between the left and right side edges; a second magnet embedded along the left side edge of the upper side panel; and a third magnet embedded along the right side edge of the upper side panel, wherein, the three magnets embedded in the upper side panel can be aligned to allow the upper side panel to close and secure to the right side panel, the left side panel, and the front cover lid panel using magnetic force.

6. The picture album of claim 1, wherein the plurality of magnets embedded along the edges of the lower side panel comprise a first magnet embedded along the bottom edge of the lower side panel between the left and right side edges; a second magnet embedded along the left side edge of the lower side panel; and a third magnet embedded along the right side edge of the lower side panel, wherein, the three magnets embedded in the lower side panel are aligned to allow the lower side panel to close and secure to the right side panel, the left side panel, and the front cover lid panel using magnetic force.

7. The picture album of claim 1, wherein the plurality of magnets along the edges of the left side panel comprise a first magnet embedded along the top edge of the left side panel; and a second magnet embedded along the bottom edge of the left side panel, wherein, the two magnets embedded in the left side panel can be aligned to allow the left side panel to close and secure to the upper side panel and lower side panel using magnetic force.

8. The picture album of claim 1, wherein the plurality of magnets embedded along the edges of the right side panel comprise a first magnet embedded along the top edge of the right side panel; a second magnet embedded along the right side edge of the right side panel; and a third magnet embedded along the bottom edge of the right side panel, wherein, the three magnets embedded in the right side panel can be aligned to allow the right side panel to close and secure to the upper side panel, lower side panel, and front cover lid panel using magnetic force.

9. The picture album of claim 1, further comprising a first magnet embedded along the top edge of the front cover lid panel; a second magnet embedded along the left side edge of the front cover lid panel; a third magnet embedded along the bottom edge of the front cover lid panel, wherein, the three magnets embedded in the front cover lid panel can be aligned to allow the panel to close and secure to the upper side panel, lower side panel, and right side panel using magnetic force.

10. The picture album of claim 1, comprising:

a picture insertion sheet with a top edge, a bottom edge opposite the top edge, and left and right side edges, comprising:

a front viewing window;

a back pocket, wherein, a picture is insertable into the back pocket so that the picture is viewed through the front viewing window located on the picture insertion sheet; and a first plurality of magnets attached at the corners of the picture insertion sheet; and a second plurality of magnets embedded in the front cover lid panel aligning to the first plurality of magnets, wherein, the second plurality of magnets allow the picture insertion sheet to attach to the front cover lid panel.

11. A picture insertion sheet comprising:

a top edge;

a bottom edge opposite the top edge;

a left edge;

a right edge opposite the left edge:

a front viewing window on a first side of the picture insertion sheet;

a back pocket on a second side of the picture insertion sheet, wherein, a picture is insertable into the back pocket so that the picture is viewed through the front viewing window; and a plurality of magnets attached along one or more of: the top edge, the bottom edge, the left edge, and the right edge of the picture insertion sheet.

12. The picture insertion sheet of claim 11 comprising a rail attaching the back pocket to a border of the second side of the picture insertion sheet.

* * * * *